US006910606B2

(12) United States Patent
Martin et al.

(10) Patent No.: US 6,910,606 B2
(45) Date of Patent: Jun. 28, 2005

(54) PISTON OPERATED FLUID DISPENSING DEVICE CAPABLE OF INCREMENTALLY ADJUSTING THE VOLUME BEING DISPENSED

(76) Inventors: James H. Martin, 8322 County Line Rd., Burr Ridge, IL (US) 60527; William M. Cannon, 2568 Ledgestone Dr., West Harrison, IN (US) 47060; Yuri Mauricio Gallegos-Cevallos, 2710 Steamboat Cir., Plainfield, IL (US) 60544; Aaron L. Hirschmann, 408 Fenmore Ct., Genoa City, WI (US) 53128

( * ) Notice: Subject to any disclaimer, the term of this patent is extended or adjusted under 35 U.S.C. 154(b) by 75 days.

(21) Appl. No.: 10/692,190

(22) Filed: Oct. 23, 2003

(65) Prior Publication Data

US 2004/0084483 A1 May 6, 2004

Related U.S. Application Data

(60) Provisional application No. 60/421,550, filed on Oct. 26, 2002.

(51) Int. Cl.[7] ..... B65D 83/00

(52) U.S. Cl. ..... 222/402.2; 222/309; 222/321.9; 222/341

(58) Field of Search ..... 222/402.1, 402.22, 222/402.23, 402.2, 309, 341, 321.7, 321.9, 509

(56) References Cited

U.S. PATENT DOCUMENTS 4,892,232 A 1/1990 Martin
5,085,351 A 2/1992 Martin
5,105,995 A 4/1992 Martin
5,183,187 A 2/1993 Martin
5,199,616 A 4/1993 Martin
5,310,092 A * 5/1994 Targell ..... 222/167
5,484,088 A 1/1996 Martin
5,915,598 A * 6/1999 Yazawa et al. ..... 222/402.1
6,695,175 B2 * 2/2004 Martin et al. ..... 222/309

* cited by examiner

*Primary Examiner*—Frederick C. Nicolas
(74) *Attorney, Agent, or Firm*—Robert L. Marsh

(57) ABSTRACT

A valve assembly includes a valve housing defining a metering chamber and an elongated stem. The stem is axially movable with respect to the valve housing for dispensing liquid and is rotatable for adjusting the length of the stroke of a piston to thereby select the volume of liquid dispensed with each actuation of the stem. A sliding float member is fitted around the stem within the chamber and is axially slidable with respect to the stem but is locked for rotation with the stem. The lower surface of the sliding float is locked for axial movement with the piston but is independently rotatable with respect to the piston. A pair of spaced poles extends parallel to the axis of the float and engages vaginations in a surface of the housing to thereby limit the length of the stroke of the piston. The poles of the float and the complementary pairs of vaginations in the housing are angularly spaced a distance of less than 180 degrees.

13 Claims, 12 Drawing Sheets

3

57
53
55
58
50
66
60
61
52
62
3

54
53
55
67
66
68
60
59
50
56
64
52
61
63
65
62

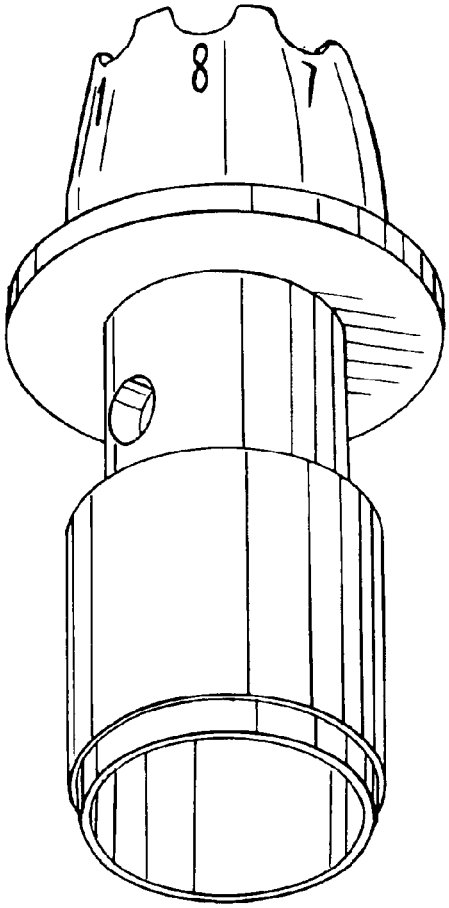
FIG. 6D
FIG. 6C
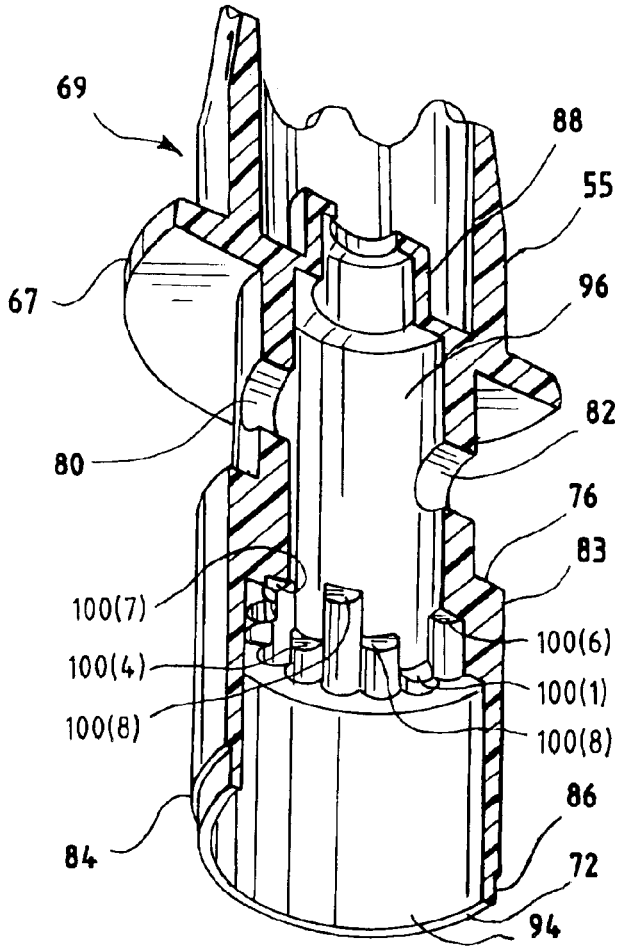

PISTON OPERATED FLUID DISPENSING DEVICE CAPABLE OF INCREMENTALLY ADJUSTING THE VOLUME BEING DISPENSED

The applicants claim priority from their previously file copending provisional application filed Oct. 26, 2002 and assigned Ser. No. 60/421,550. The present application relates to devices for dispensing a predetermined volume of liquid, as for example, for medication, and in particular to an adjustable device in which one can incrementally increase the volume of liquid being dispensed by rotating the stem to discharge positions corresponding to such incremental changes.

BACKGROUND OF THE INVENTION

Certain liquids, for example liquid medication, are needed in small predetermined volumes, and therefore it is desirable to have a dispensing device for dispensing predetermined volumes of liquid. In my U.S. Pat. No. 4,892,232 I disclosed such a device.

The amount of a certain medication needed by a first patient may, however, be different from the amount of the same medication needed by a second patient. For example, the amount of Tylenol that should be administered to a child depends upon the child's weight, with a ratio of 10 milligrams per 2.2 pounds of weight (one kilogram). A forty-four pound child should therefore receive a dosage of 200 milligrams and a fifty-five pound child should receive 250 milligrams. As a child grows, the dosage of this medication that he or she should receive, therefore, grows proportionate to his or her weight change. It is desirable, therefore, to provide a dispensing valve for which the volume of liquid being dispensed can be incrementally increased or decreased across a range of volumes to accommodate such needs.

An adjustable dose dispenser having a plurality of different sized metering chambers with a stem rotatable to select the chamber to be discharged was disclosed in my U.S. Pat. No. 5,085,351. In that device, each of the metering chambers had a flexible wall. Since this device required a separate metering chamber for each volume to be dispensed, the number of selected volumes available for one valve was limited to three or four.

As an alternative to selecting one of a plurality of chambers for varying the volume of fluid to be dispensed, a device can have a single chamber where the volume dispense from the chamber is adjustable. This can be accomplished by providing a piston for dispensing the liquid from the chamber where the length of the piston stroke is adjustable, as disclosed in my previously issued U.S. Pat. No. 5,813,187. The piston operated dispensing device of U can dispense a wide range of volumes of liquid, but the device as described in my above mentioned patent has certain problems.

One problem is that the volume of liquid being dispensed is adjusted by rotating the stem of the dispensing valve and the valve stem is connected a threaded stop member which rotates with the stem to vary the stroke of the piston. To operate properly, however, the piston is sealed against the cylindrical wall of the metering chamber and the seal around the perimeter of the piston creates resistance, inhibiting the manual rotation of the dispensing stem.

Another problem relates to the structure of a piston moveable within a cylindrical wall. To prevent the twisting of the piston within the wall of the valve housing, the threads or the steps that limit the stroke of the piston should provide should provide at least two limiting stop members, with the stop members spaced evenly around the circumference of the housing. Where two such stop members are positioned in diametrically opposed positions in the housing, only 180 degrees of rotation of the stem is available to vary the length of the stroke of the piston. As a result, the variability of the adjusting quality of the valves is diminished.

Another problem is that the device includes a spring for urging the piston in a direction that maximizes the volume of the metering chamber and the other end of the spring is fitted against a surface of the housing of the valve such that on rotation of the stem either the piston rotates with respect to the spring or the spring rotates with respect to the housing. In either case the movement of the plastic of the housing or of the piston against the spring causes particles of plastic to sheer off and enter the liquid being dispensed. The continuing use of the dispenser causes those particles to obstruct the small passages that extend through the stem of the dispenser and thereby inhibit its operation.

There is therefore, a need for an improved piston operated dispensing apparatus in which the volume. of liquid being dispensed may be more easily adjusted and which will not cause small particles of plastic to be released into the liquid.

SUMMARY OF THE INVENTION

Briefly, the present invention is embodied in a dispensing valve for use in a dispensing device consisting of a container filled with a pressurized liquid. In the preferred embodiment, portions of the valve extend above the upper surface of the container. The valve includes a stem the upper end of which is rotatable about its longitudinal axis and is axially moveable with respect to the enclosure and the body of the valve. The direction of the discharge nozzle is rotatable to any one of a predetermined number of discharge positions and the stem may be depressed to discharge a quantity of liquid or gel only when the discharge nozzle is at one of the predetermined discharge positions. The dosage of liquid to be dispensed for each of the discharge positions is printed on the upper portion of the valve near the associated position.

The valve has a generally tubular housing having an open lower end into which a piston is axially moveable. Within the housing is a cavity the outer walls of which are formed by the housing and the lower wall is defined by the upper surface of the piston such that the cavity is constricted as the piston moves upward within the housing.

The stem which extends axially through the upper end of the housing has an axial passage with a discharge opening at the upper end thereof and a second port extending through a wall in the stem. The stem is axially moveable between an extended position wherein the port in the wall of the stem is sealed against portions of the tubular housing, and a depressed position in which the port in the wall of the stem is in communication with the cavity such that liquid therein can be released to the ambient. A spring urges the stem to the extended position.

The valve further includes a float within the cavity which is locked for rotation with the stem, but is axially moveable within the cavity independent of the stem. The float provides means for limiting the movement of the piston within the cavity. In the preferred embodiment, the float has two poles angularly spaced from each other but not necessarily at diametrically opposite positions from each other, such that when the piston moves upward through the cavity, the poles of the float engage a surface on the housing at the upper end of the cavity.

Surrounding the aperture for receiving the stem in the upper end of the cavity, the housing has a plurality of invaginations arranged in pairs with the depth of each of the pairs being different from the depth of any other pair and the members of each pair of invaginations angularly spaced about the axis of the valve for receiving the poles of the float. Rotation of the stem of the valve to one of the preselected activation positions causes a corresponding rotation of the float within the cavity and the rotation of the poles to engage the invaginations corresponding to the markings on the exterior of the housing near the selected activation position.

Where the valve has an even number of discrete discharge selections, with each selection corresponding to a different volume of liquid being discharged through the valve, the poles on the float cannot be diametrically opposed to each other. If the poles were diametrically opposed to each other, the two members of each of the pairs of invaginations in the housing would also have to be diametrically opposed to each other and the valve would discharge exactly the same amount of liquid for any two diametrically opposed angular settings of the discharge valve. The consequence of such a configuration would be that the valve could be adjusted only through 180 degrees, rather than through 360 degrees, thereby limiting the number of volume selections to which the stem can be rotated.

Where the valve is configured to be adjustable to an odd number of settings, the invaginations in the upper surface of the housing may be positioned diametrically opposed to each, however, a means for keying the angular orientation of the float with respect to the stem must be provided, and we have found that the keying can be simplified by providing a pair of longitudinal ribs on the float which engage complementary pairs of longitudinal slots in the stem with the ribs on the float oriented adjacent to the poles. To insure that the parts can be assembled in only one orientation, it is preferable that the poles therefore not be diametrically apart from one another. It should be appreciated, however, that the measuring systems currently in use divide the units of volume into eighths or tenths, and therefore, it is desirable to provide a dispensing device in which the volume of liquid being dispensed is in units of one-eight or one-tenth of the maximum dispensable volume. Eighths or tenths are both even numbered numbering systems.

One feature of the present invention is that the refill port for admitting liquid into the cavity extends through a wall in the housing, rather than through a hole in the piston as was the case with prior art piston operated valves. Prior art valves having refill ports that extend through the piston relied upon a seal between the outer circumference of the piston and the inner wall of the housing to prevent leakage of liquid from the surrounding container into the cavity during discharge. Such leakage alters the accuracy of the dosage being dispensed and in the case of a sever leakage, holding the stem in the depressed condition for a lengthy period of time can result in the discharge of the entire contents of the container.

The valve of the present invention includes a diaphragm extending across the lower open end of the tubular housing that seals against the lower surface of the piston to provide a leakproof seal so as to prevent liquid from seeping around the outer edges of the piston and into the cavity.

Yet another advantage of the present invention is that the piston is urged downward within the housing by a coil spring which extends around the circumference of the float so as not to cause resistance to the rotation of the float. As a result, an operator may easily rotate the stem and float to a chosen selected volume without causing damage to the parts or incurring undue resistance.

BRIEF DESCRIPTION OF THE DRAWINGS

A better understanding of the present invention will be had after reading of the following detailed description taken in conjunction with the drawings wherein:

FIG. 6C is a broken isometric view of the housing shown in FIG. 6 exposing several of the invaginations therein; FIG. 6D is another isometric view of the housing of the valve shown in FIG. 4;

FIG. 8A;

DETAILED DESCRIPTION OF A PREFERRED EMBODIMENT

Figure 1:
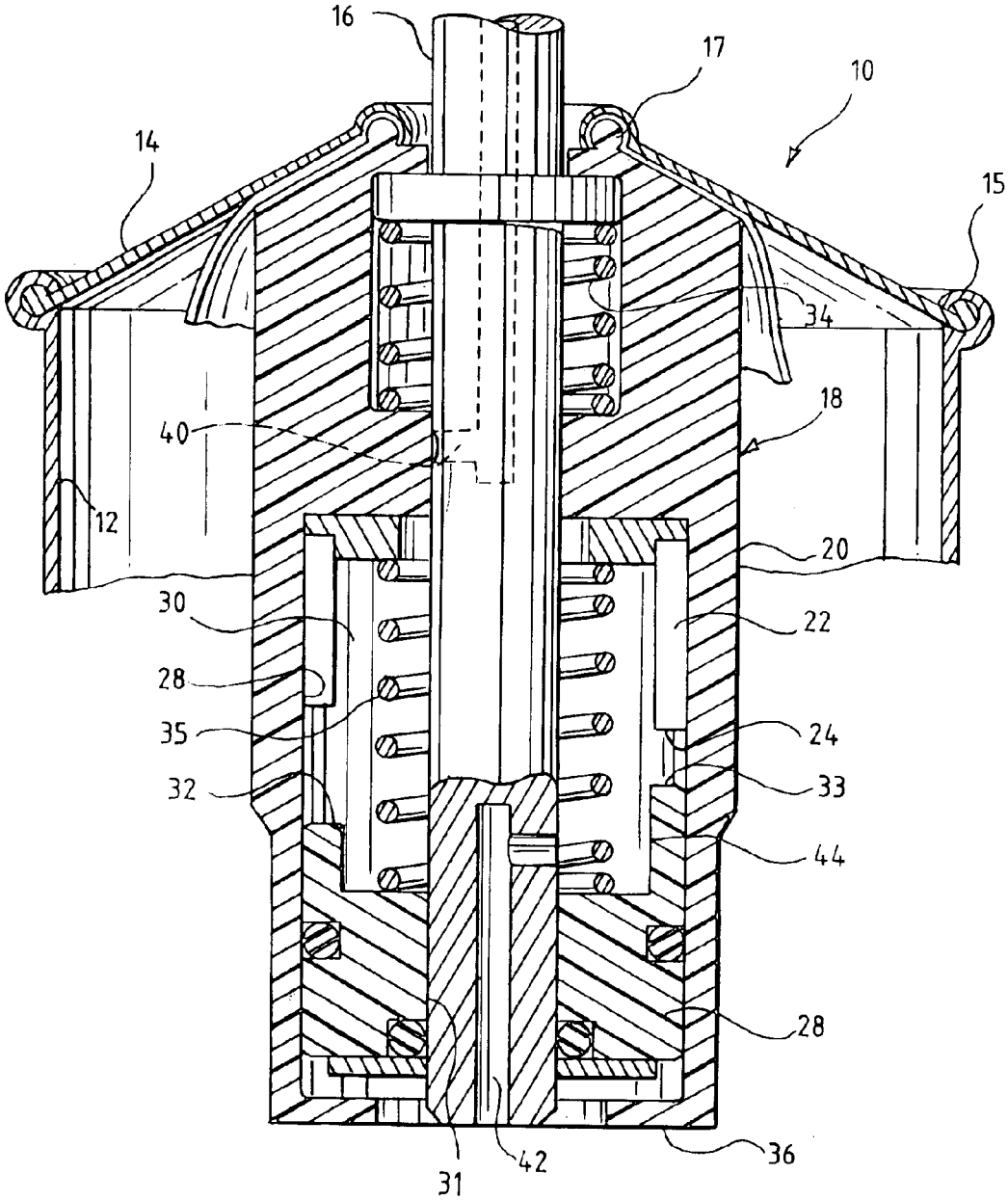
FIG. 1 PRIOR ART
FIG. 1 is a fragmentary cross sectional view of a piston operated dispensing device in accordance with the prior art.

Referring to FIG. 1, a piston operated adjustable dose dispenser 10 in accordance with the prior art includes a pressurized container 12 having a cap 14 with a crimp 15 around the outer circumference of the cap 14 to retain the cap 14 to the retainer 12. A discharge stem 16 extends from a rim 17 at the upper end of a valve assembly 18, the lower end of which extends into the cavity of the container 12. A second crimp joins the rim 17 at the upper end of the valve to the cap 14 of the container 12. The valve assembly 18 includes a cylindrical housing 20, the stem 16, a piston 26, and a sleeve 22, the lower surface 24 of which has either a spiraled configuration or a plurality of steps with each step defining a different longitudinal position along the length of the housing 20. The piston 26 is positioned at the lower end of the housing and has an inner surface which, along with the inner surface 28 of the housing 20, defines a variable volume cavity 30, with the volume of the cavity 30 varying with axial movement of the piston 26.

The piston 26 has a noncircular central opening 31 that fits around a complementarily shaped noncircular portion of the stem 16 such that the piston 26 is axially moveable with respect to both the housing 20 and the stem 16, but will rotate within the housing 20 upon rotation of the stem 16. Around the circumference of the upper surface of the piston 26 is one or more projections 32, 33 which extend axially along the inner surface 28 of the housing 20 and engage portions of the lower surface 24 of the sleeve 22. By rotating the piston 26 the positioning of the projections 32, 33 is changed with respect to the lower surface 24 of the sleeve 22, thereby varying the length of the stroke of the piston 26.

A first coil spring 34 urges the stem 16 outward of the container 12 and a second coil spring 35 urges the piston 26 away from the lower end 24 the sleeve 22 and towards a stop 36 at the lower end of the cylindrical housing 20. Rotation of the stem 16, therefore, causes rotation of the piston 26 and thereby adjusts the length of the stroke of the piston 26 within the cavity 30.

The discharge stem 16 has a first axial passage 38 extending from the upper end thereof to a port 40 in the side wall thereof which, when the stem 16 is depressed, provides communication between the interior of the cavity 30 and the ambient. The stem 16 also has a second axial passage 42 extending through the lower end thereof and opening through a second port 44 for providing communication between the cavity 30 and the interior of the pressurized container 12 when the stem is not depressed.

When the stem 16 is not depressed, as shown in FIG. 1, the cavity 30 is in communication with the pressurized liquid and the container 12 through the second passage 42 and the spring 34 urges the piston 24 towards the lower stop 36 to fill the cavity 30 with liquid. When the stem 16 is subsequently depressed the port 44 is closed and the port 40 is opened to ambient pressure. The pressurized liquid in the container 12 thereafter causes movement of the piston 26 forcing liquid through the first passage 38 and expelling it through the upper end of the stem 16 until the piston 26 reaches the lower end 24 of the sleeve 22.

A problem with this embodiment can occur if the pressurized liquid in the container leaks around the sides of the piston 26 and enters the cavity 30. This is likely to occur if the piston twists or becomes cocked within the tubular inner surface 28 of the housing 20. To prevent the twisting of the piston 28 within the housing 20, the lower surface 24 of the sleeve 22 is configured into two spirals or sets of steps, with each of the spirals or set of steps extending around only 180 degrees of the circumference of the housing. The piston 26 also has two upwardly extending parallel projections 32 that are 180 degrees apart such that one projection 32 engages one of the spirals or set of steps on the surface 24 and the second projection 24 engages the second spiral or set of steps on the surface 24. As a result, the volume of the liquid being dispensed by the valve assembly 18 is varied during the rotation of the stem 16 through only 180 degrees because the second 180 degrees of rotation is identical to the first 180 degrees.

In the embodiment depicted rotation of the stem 16 causes rotation of the piston 26. The second coil spring 35 extends between the nonrotatable second sleeve 22 and the rotatable piston 26 causing the metal parts of the spring 35 to scrape loose particles from either the sleeve 22 or the piston 26. Also, the piston 26 is sealed around its perimeter to prevent leakage and the seals cause resistance to rotation of the stem 16. The operator is therefore required to exert substantial force to rotate the stem, and the stem 16 must be adequately engineered to endure the torque applied thereto.

Figure 2:
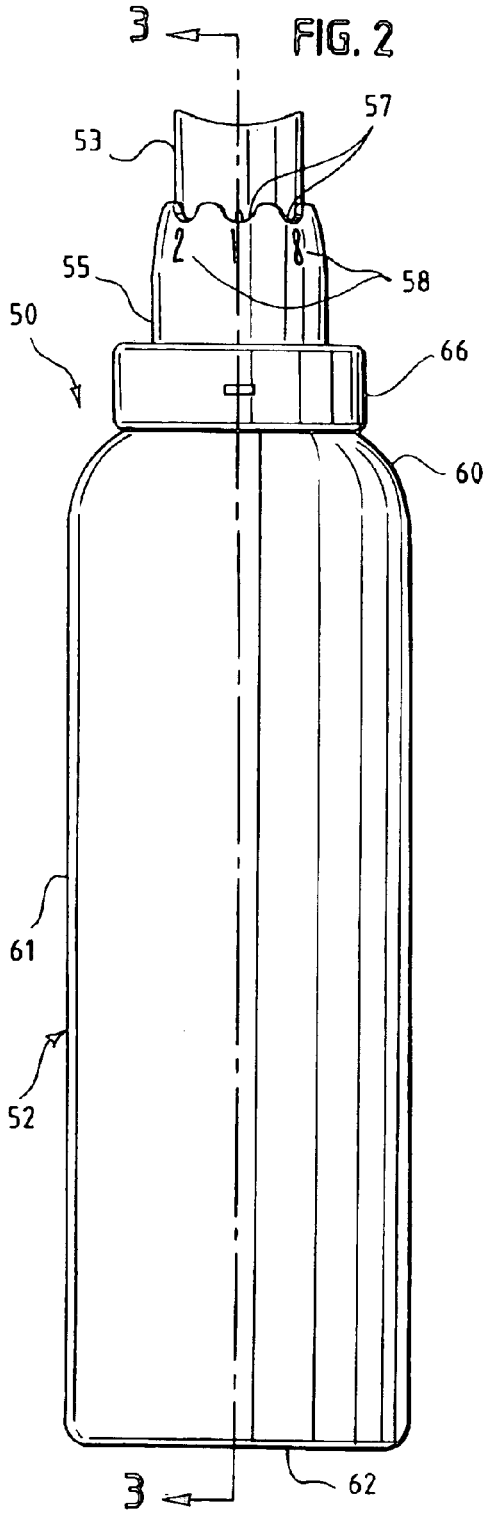
FIG. 2 is a side elevational view of a dispensing container having a dispensing valve according to the present invention.
Figure 3:
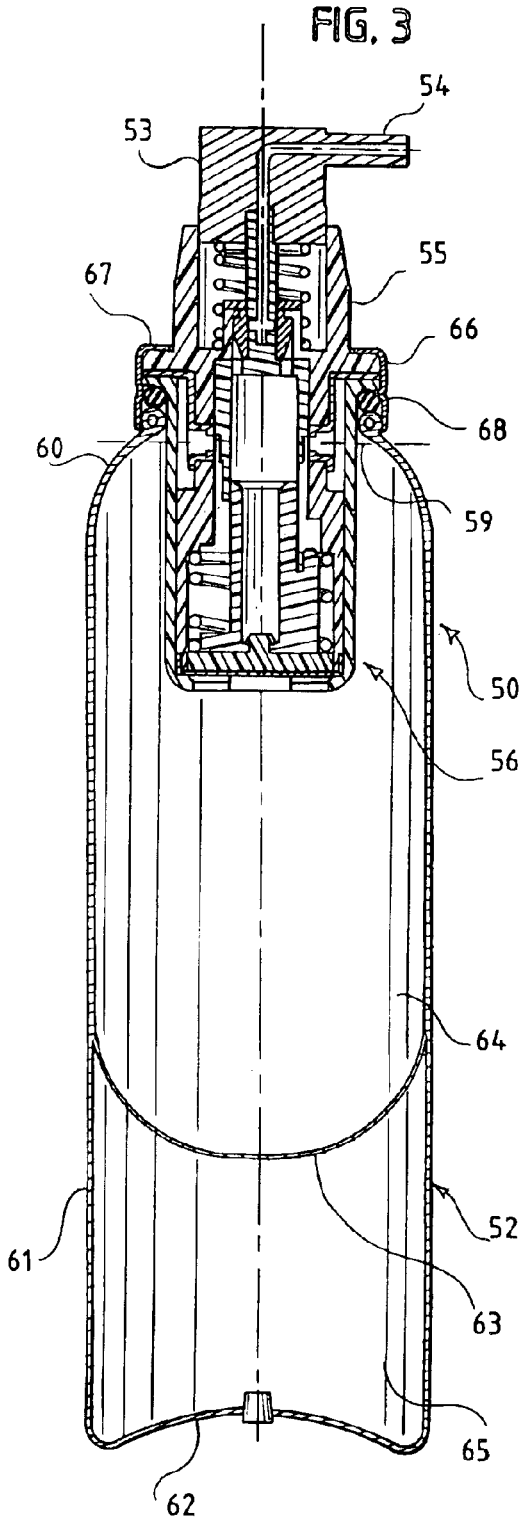
FIG. 3 is a cross-sectional view of the container and valve shown in FIG. 2 taken through line 3—3.
Figure 4:
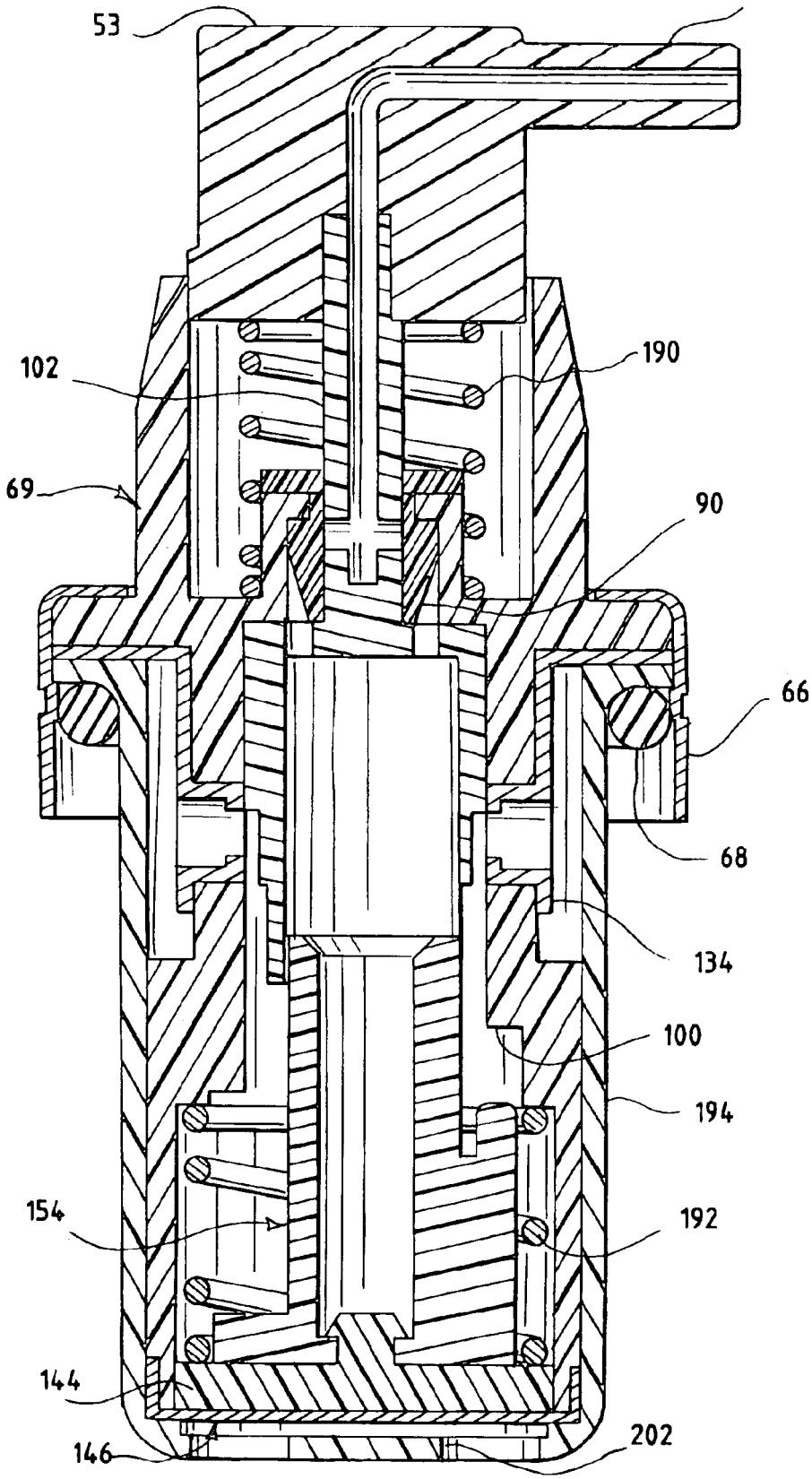
FIG. 4 is an enlarged cross-sectional view of the valve shown in FIG. 3 prior to attachment to a container, with the actuator in the elevated position.
Figure 5:
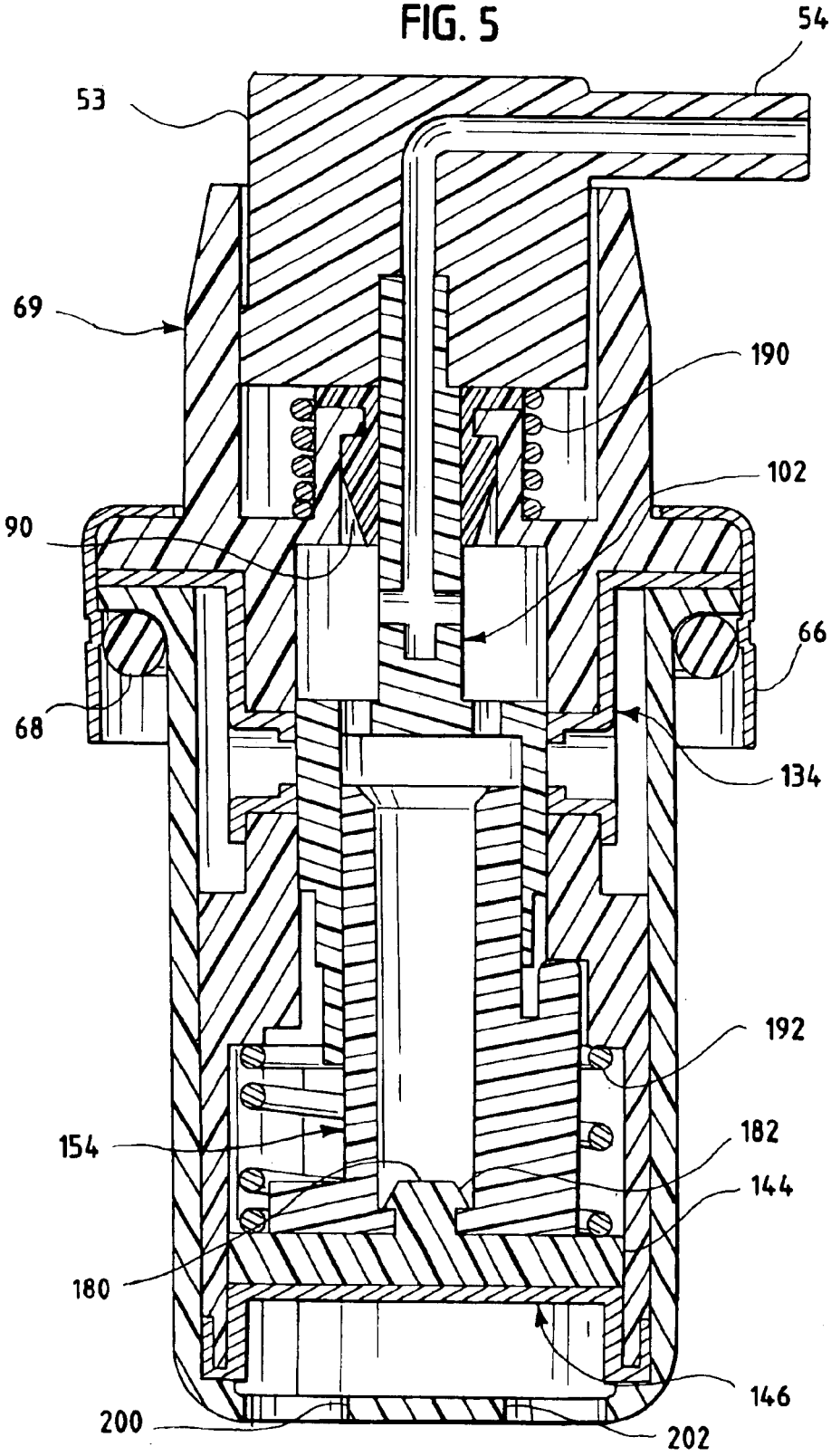
FIG. 5 is a further enlarger cross-sectional view of the valve shown in FIG. 2 prior to attachment to a container, with the actuator in the depressed position.

Referring to FIGS. 2 and 3, a dispenser 50 according to the present invention includes a pressurized cylindrical container 52 at the upper end of which is an actuator cap 53 having an elongate radially extending discharge nozzle 54. Surrounding the base of the actuator cap 53 and extending above the upper surface of the container 52 is an upper portion 55 of a valve 56 in accordance with the present invention. The upper portion 55 of the valve 56 has a plurality of notches 57 around the circumference and printed near each notch 57 is a marking 58 indicative of the dosage of liquid to be dispenses upon the depression of the actuator with the nozzle 54 received into the associated notch 57. The valve 56 is configured to administer a graduated range of dosages with the minimum dosage occurring when the nozzle 54 is received in the notch 57 having number 1 as the adjacent marking 58. Each successive notch bears a successively larger marking 58 indicative of an incrementally larger dosage of the liquid administered by the valve. The open upper portion 55 is depicted as having eight notches 57 such that the actuator cap 53 can be rotated to any of the eight positions and will dispense a different amount of liquid 59 when the nozzle 54 is received in each of the eight notches 57.

The container 52 has an opening 59 at the upper end, and outward of the opening 59 is a shoulder 60 which extends to a cylindrical wall 61 at the lower end of which is a bottom 62. Fitted within the opening 59 of the container 52 is a flexible bag 63 filled with a liquid 64 to be dispensed. A propellant 65, which may be a compressible gas such as carbon dioxide or a volatile hydrocarbon liquid, surrounds the bag 63 and creates pressure within the interior of the container 52 for exhausting the liquid 64 through the valve assembly 56. The parts, including the container 52, the bag 63, and the valve 56, are held in assembled relationship by a ferrule 66 that is crimped around a radial flange 67 on the valve 56, a bead around the opening 59 of the container 52, the upper end of the bag 63, and an O-ring 68 which, when the ferrule is crimped, forms a seal.

Referring to FIGS. 3 through 6F, the valve 56 includes a generally tubular housing 69, the upper portion 55 of which extends above the ferrule 66 and has the notches 57 at the upper end thereof and markings 58 printed near each notch 57. Extending radially outward from below the upper portion 55 is the radial flange 67 to which the ferrule 66 attaches. The housing 69 also has a longitudinal axis 70, an open lower end 72, and between the flange 67 and the open lower end 72 is an upwardly facing annular shoulder 76 leaving a reduced diameter tubular central portion 78 extending between the flange 67 and the shoulder 76. Piercing the tubular central portion 78 are a pair of opposing transverse refill ports 80, 82. Below the upwardly facing shoulder 76 is a lower tubular portion 83 and extending around the lowermost end thereof adjacent the lower end 72 is a downwardly facing shoulder 84 forming a smaller diameter cylindrical lip 86.

Referring to FIGS. 4, 5, 6B, 6C, 10, and 10A, within the central opening of the housing 69 and near the upper portion 55 thereof is a generally cylindrical inner retainer 88 for retaining a tubular elastomeric seal 90 having a cylindrical inner wall 92. Adjacent the open lower end 72 of the housing 69 is a cylindrical inner wall 94 and above the cylindrical inner wall 94 is a narrower central cylindrical inner wall 96 at the upper end of which is an inwardly directed flange 98 to which the tubular inner retainer 88 is mounted.

Referring to FIGS. 6B, 6C, 6E, and 6F, the inner wall of the housing 69 immediately above the cylindrical inner wall 94 consists of a plurality of invaginations 100 arranged in pairs numbered from 100(1) to 100(8), with each of the pairs being of different depth than any other of the pairs of invaginations as is further described below.

Referring to FIGS. 4, 5, and 7 to 7E, axially moveable within the housing 69 is a stem 102 having a narrow diameter, generally cylindrical upper portion 104 having a flat 106 near the uppermost end thereof. Below the upper portion 104 is a radially flange 108 and below the flange 108 is a large diameter tubular lower end 110. The cylindrical upper portion 104 has an axial passage 112 extending therethrough, with the passage 112 having an upper opening 113 at the upper end of the upper portion 104 and a second opening 114 in the outer wall of the upper portion 104 a short distance above the radial flange 108. Extending through the radial flange 108 are a plurality of holes 115, 116 which extend parallel to the longitudinal axis 118 of the stem 102 for allowing liquid to flow between the opposite faces of the radial flange 108 and in and out of the interior of the tubular lower portion 110.

Figure 6:
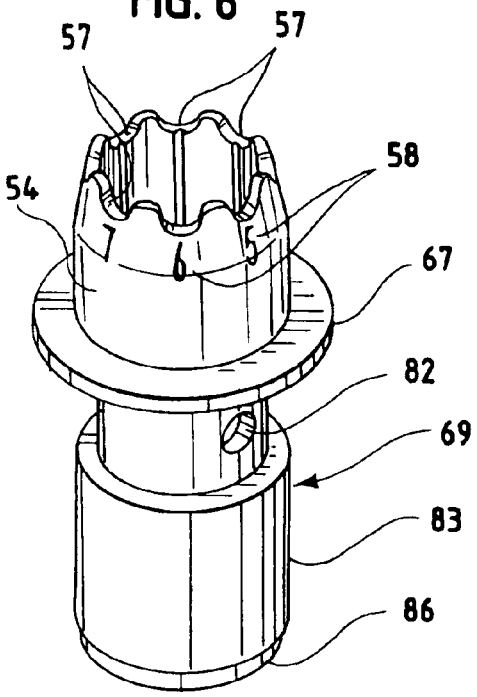
FIG. 6 is an isometric view of the housing of the valve shown in FIG. 4.
Figure 6A:
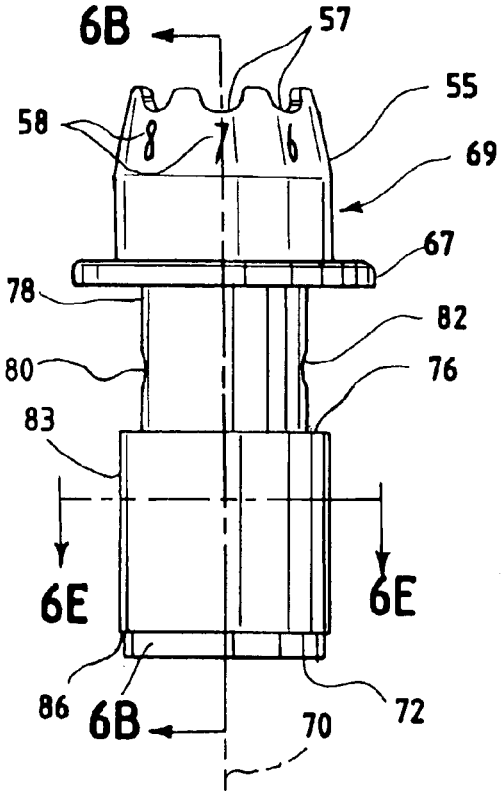
FIG. 6A is a side elevational view of the housing shown in FIG. 6.
Figure 6B:
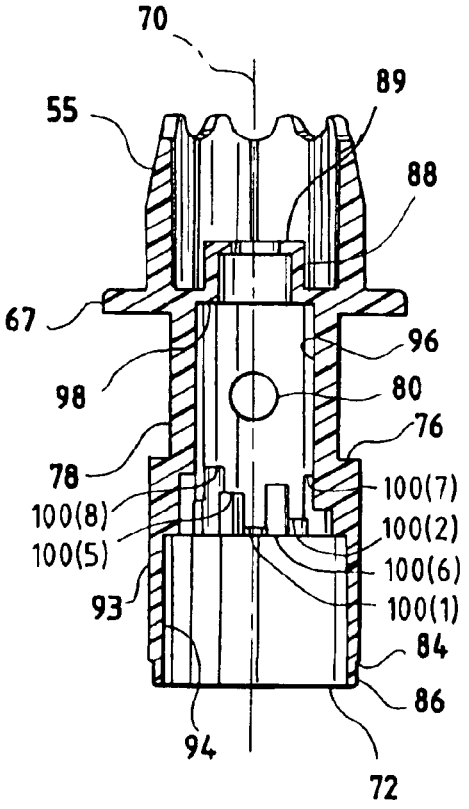
FIG. 6B is a cross-sectional view of the housing shown in FIG. 6 taken through line 6B—6B of FIG. 6A.
Figure 6E:
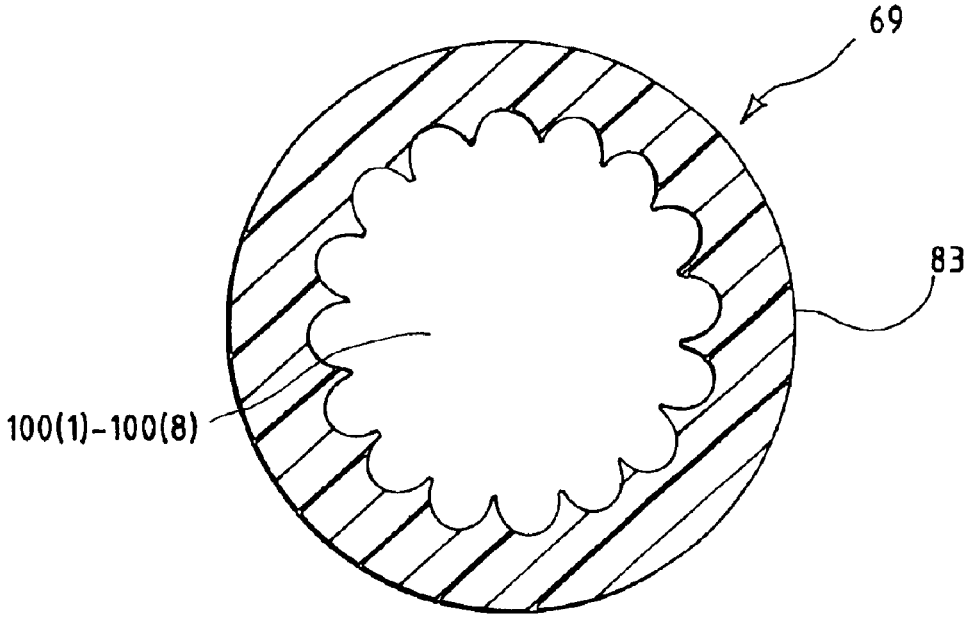
FIG. 6E is a cross-sectional view of the housing shown in FIG. 6 taken through line 6E—6E of FIG. 6A with the configuration of the pairs of invaginations marked therein.
Figure 6F:
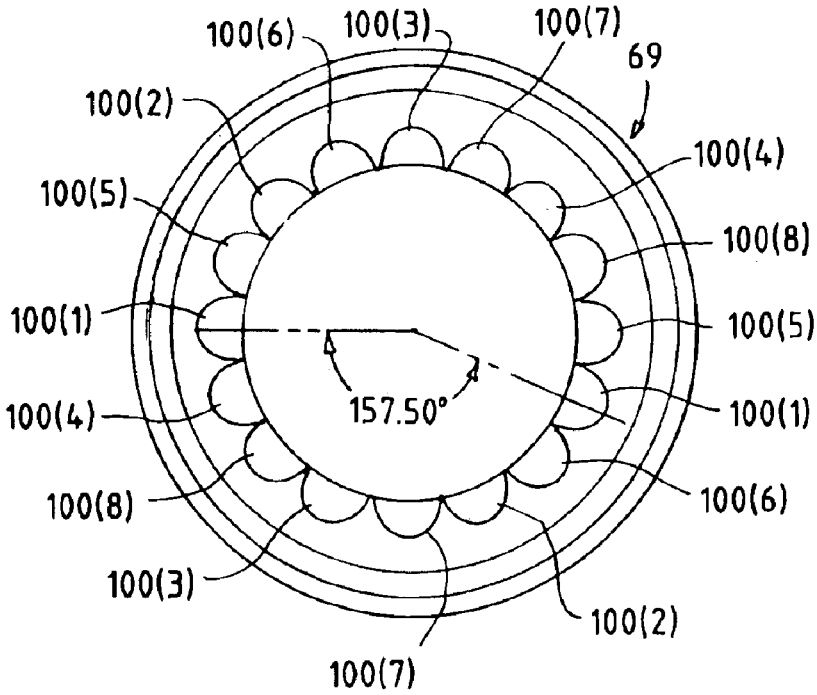
FIG. 6F is a greatly enlarged bottom elevational view showing the arrangement of the invaginations for receiving the poles of the float.
Figure 7C:
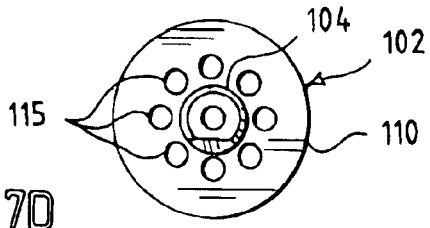
FIG. 7C is a top view of the stem shown in FIG. 7.
Figure 7D:
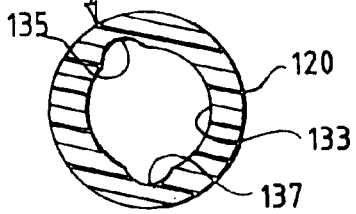
FIG. 7D is a cross-sectional view of the stem shown in FIG. 7 taken through line 7D—7D of FIG. 7A.
Figure 7E:
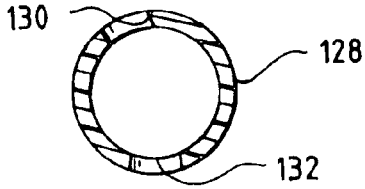
FIG. 7E is a cross-sectional view of the stem shown in FIG. 7 taken through line 7E—7E of FIG. 7A.
Figure 7:
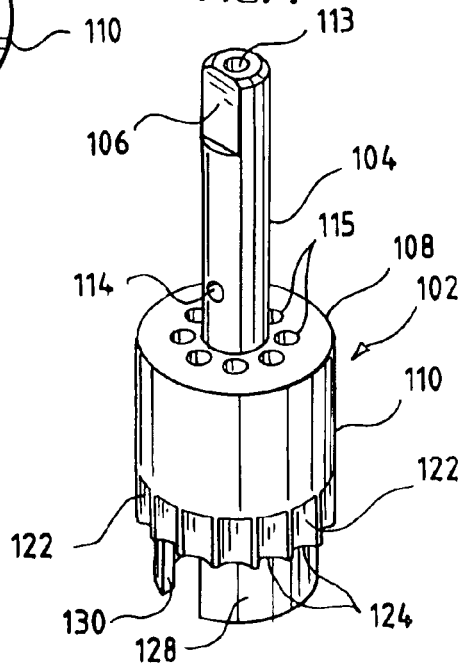
FIG. 7 is an isometric view of the stem for the valve shown in FIG. 4.
Figure 7A:
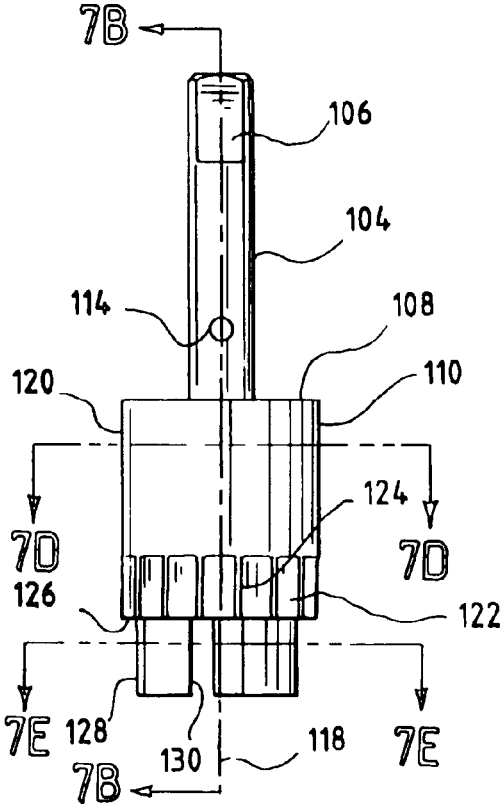
FIG. 7A is a side elevational view of the stem shown in FIG. 7.
Figure 7B:
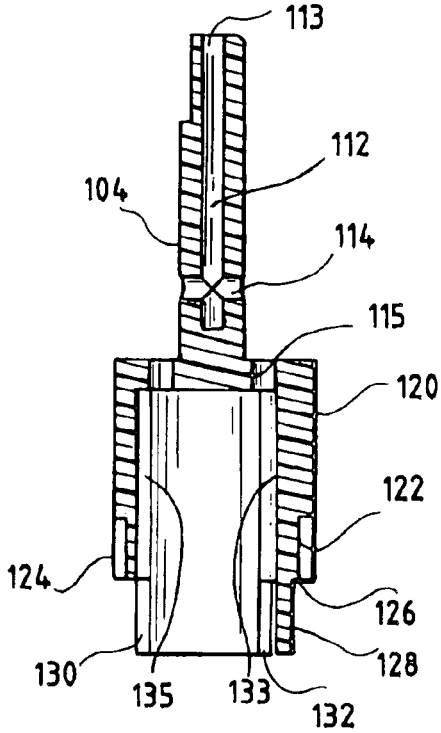
FIG. 7B is a cross section al view of the stem shown in FIG. 7 taken through line 7B—7B of FIG. 7A.

The flange 108 extends across the upper end of the tubular lower portion 110; the tubular lower portion 110 having a cylindrical outer wall 120. Below the cylindrical outer wall 120 are a plurality of longitudinal indentations 122 leaving a plurality of parallel ridges 124 between the indentations 122 with the outer surface of the ridges 124 defined by the cylindrical outer wall 120. Below the indentations 122 and ridges 124 is a downwardly facing annular shoulder 126 and below the downwardly facing annular shoulder 126 is a lower tubular portion 128 having a pair of longitudinal slots 130, 132 therein. As best shown in FIGS. 7D and 7E, extending upward into the inner surface 133 of the stem adjacent the indentations 122 and the cylindrical surface 120, are grooves 135, 137 which are upward extensions of the slots 130, 132. The slots 130, 132 and their extensions 135, 137 are widely spaced from one another but are nonetheless not diametrically apart from one another. Since the valve assembly 62 is adapted to dispense a volume of liquid incrementally changeable through eight different increments, the slots 130, 132 and grooves 135, 137 are angularly spaced from one another by 157.50 degrees in one direction and 202.50 degrees in the opposite direction, as shown in FIG. 6F for the reason set forth further below.

Referring to FIGS. 4, 5, 6, 6A, 11, 11A, and 11B, fitted around the tubular central portion 78 to the housing 69 is a rubberized generally cylindrical refill port seal 134 having an elastomeric tubular body 136 sized to fit around the tubular central portion 78 of the housing 69 between the lower surface of the flange 67 and the upwardly extending annular shoulder 76. At the upper end of the tubular body 136 is a radial flange 138 which engages the lower surface of the radial flange 67 as shown in FIG. 3. Extending through the walls of the tubular body 136 are a pair of opposing tubular nipples 140, 142 the outer surfaces of which are adapted to fit within the refill ports 80, 82 of the housing 69 and create a seal against the tubular portion 120 of the stem 102 when the stem 102 is in the depressed condition as is further described below.

Referring to FIGS. 4, 5, 6B, 12, 12A, and 12B, fitted within the cylindrical inner wall 94 of the housing 69 is an axially moveable piston 144. Across the open lower end 72 of the housing 69 and below the piston 144 is a flexible, generally circular diaphragm 146 having a cylindrical outer ridge 148 that fits around the reduced diameter cylindrical lip 86 below the downwardly facing shoulder 84 of the housing 69. The central portion of the diaphragm 146 is bonded to the lower surface of the piston 144, such that the piston 144 is retained to the central portion of the diaphragm 146. As can be seen, the cylindrical inner wall 94 of the housing 69, the upper end of the invaginations 100(1)–100(8) thereof, and the upper surface of the piston 144 form a cavity 145, the volume of which becomes reduced as the piston 144 moves upwardly within the cylindrical wall 94.

Figure 8C:
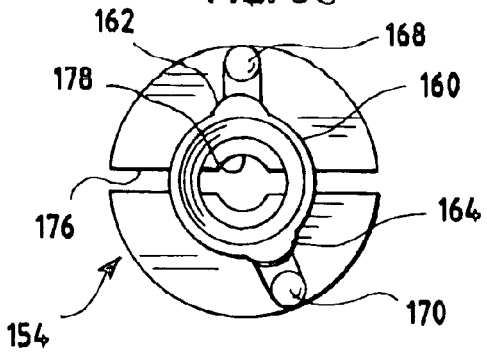
FIG. 8C is a top view of the float shown in FIG. 8.
Figure 8:
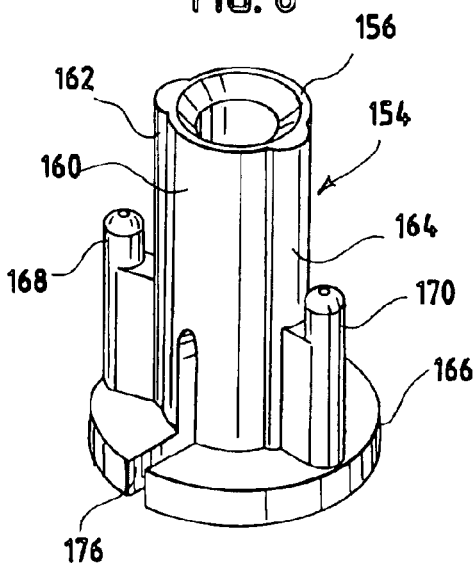
FIG. 8 is an isometric view of a float for the valve shown in FIG. 4.

Referring to FIGS. 4, 5, 6B, 7B, 7D, and 8 through 8D, fitted within the cavity 145 between the invaginations 100(1)–100(8) in the housing 69 and the piston 144 is a generally tubular float 154 having an upper end 156 and a lower end 158. The float 154 has a generally tubular central body 160, the outer diameter of which is sized to slideable fit within the lower tubular portion 128 of the stem 102. Extending along the outer surface of the tubular central body 160 are a pair of longitudinal ribs 162, 164 which are not diametrically apart from one another, but are spaced an angular distance of 157.50 degrees in one direction and 202.50 degrees in the opposite direction as best shown in FIG. 8C. At the lower end 158 of the central body 160 is a radial flange 166 having circular periphery, the diameter of which is significantly less than the outer diameter of the piston 144. Extending forward of the radial flange 166 are a pair of poles 168, 170 with each pole 168, 170 spaced radially outward of one of the ribs 162, 164 such that the poles are angularly spaced from one another by an angular distance of 157.50 degrees in one direction and 202.50 degrees in the opposite direction.

Figure 8D:
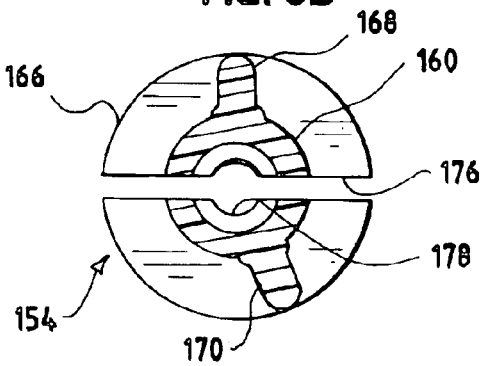
FIG. 8D is a cross-sectional view of the float shown in FIG. 8 taken through line 8D—8D of FIG. 8A.
Figure 8A:
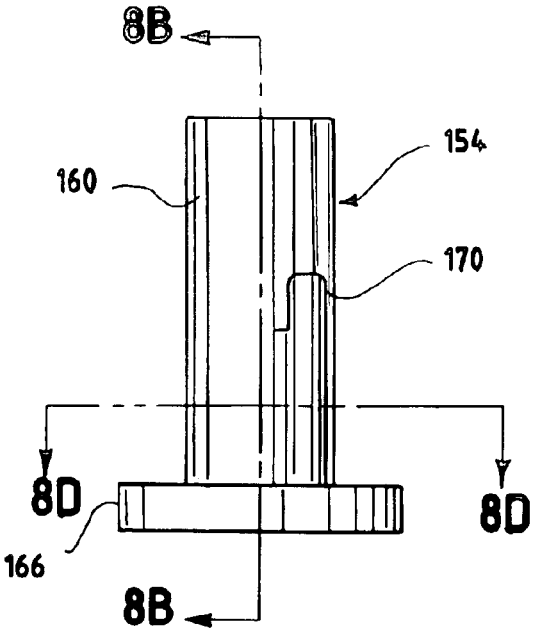
FIG. 8A is a side elevational view of the float shown in FIG. 8.
Figure 8B:
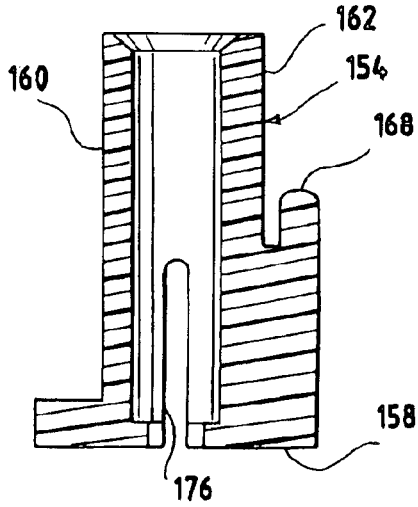
FIG. 8B is a cross-sectional view of the float shown in FIG. 8 taken through line 8B—8B of FIG.
Figure 9A:
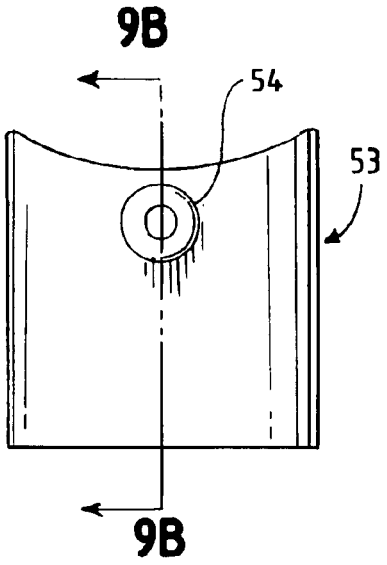
FIG. 9A is a front elevational view of the actuator cap shown in FIG. 9.
Figure 9B:
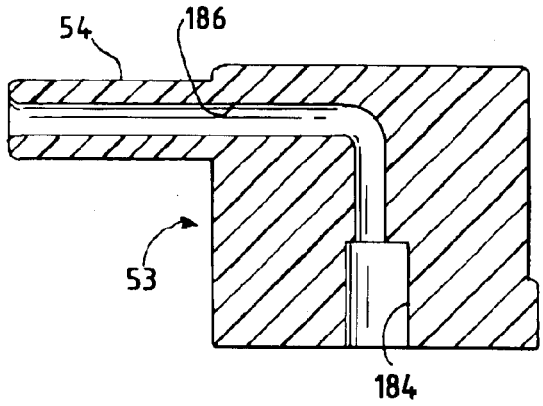
FIG. 9B is a cross-sectional view of the actuator cap shown in FIG. 9 taken through line 9B—9B of FIG. 9A.
Figure 9:
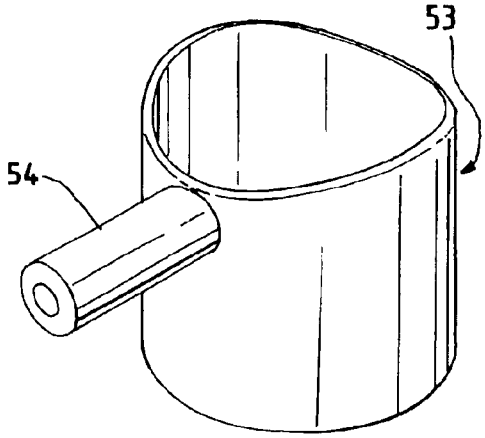
FIG. 9 is an isometric view of an actuator cap for the valve shown in FIG. 4.
Figure 10:
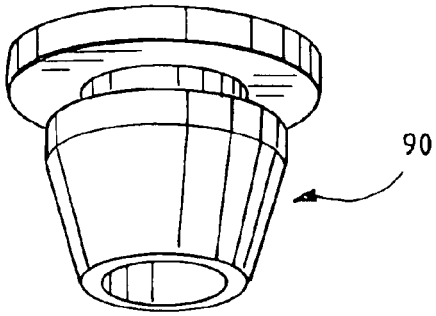
FIG. 10 is an isometric view of a seal for the upper portion of the housing of the valve shown in FIG. 4.
Figure 11:
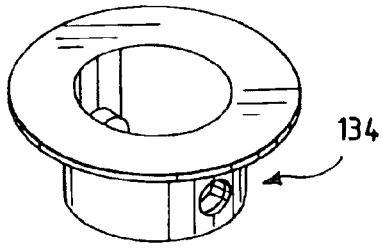
FIG. 11 is an isometric view of a refill port seal for the valve shown in FIG. 4.
Figure 10A:
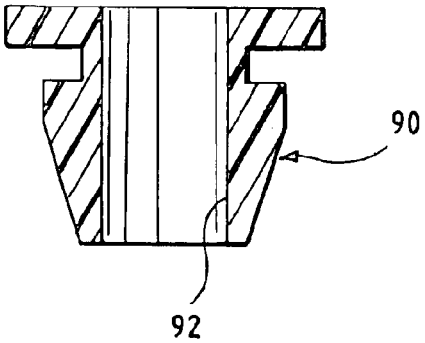
FIG. 10A is a cross-sectional view of the seal shown in FIG. 10.
Figure 11A:
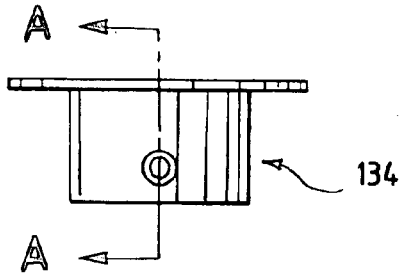
FIG. 11A is a side elevational view of the refill port seal shown in FIG. 11.
Figure 11B:
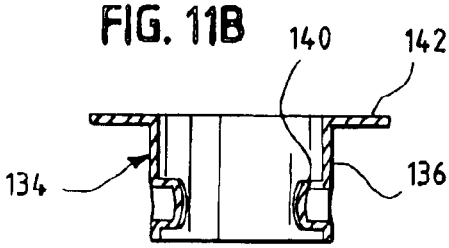
FIG. 11B is a cross-sectional view of the refill port seal shown in FIG. 11 taken through line 11B—11B of FIG. 11A.
Figure 12:
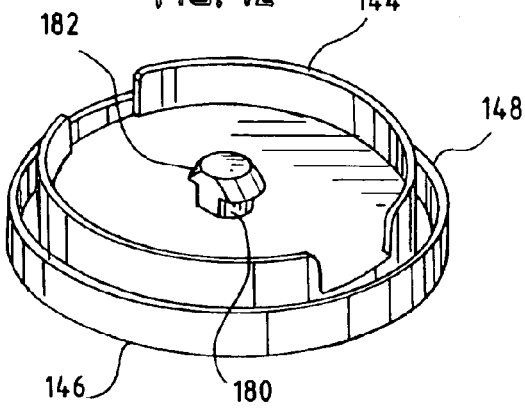
FIG. 12 is an isometric view of a piston for the valve shown in FIG. 4 with a diaphragm secured to the lower surface thereof.
Figure 13:
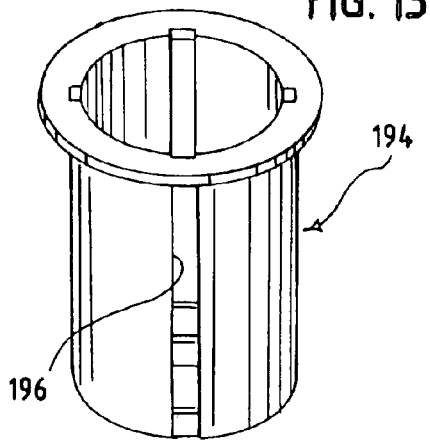
FIG. 13 is an isometric view of an enclosure for the valve shown in FIG. 4.
Figure 12A:
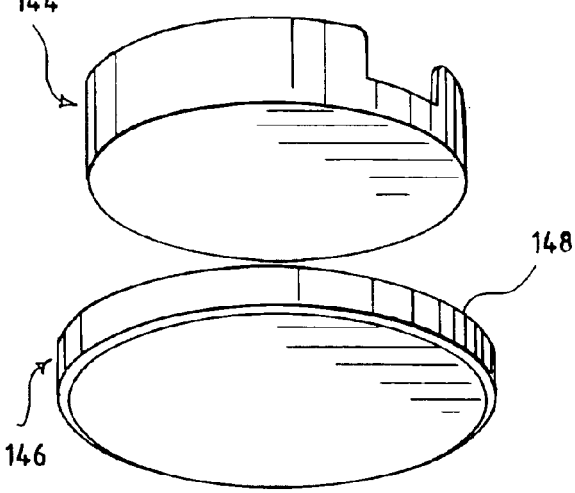
FIG. 12A is another isometric view of the piston and diaphragm shown in FIG. 12 with the parts exploded from one another.
Figure 13A:
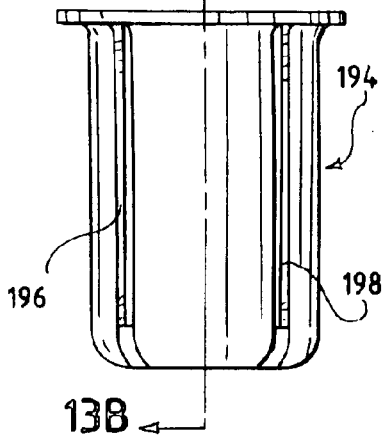
FIG. 13A is a side elevational view of the enclosure shown in FIG. 13.
Figure 12B:
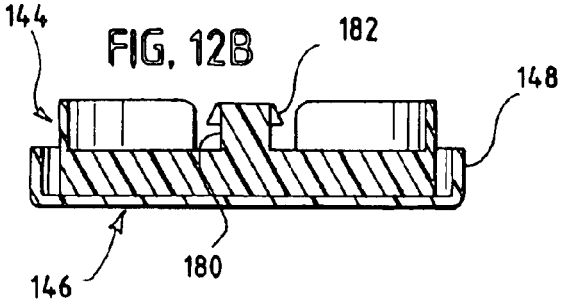
FIG. 12B is a cross-sectional view of the piston and diaphragm shown in FIG. 12.
Figure 13B:
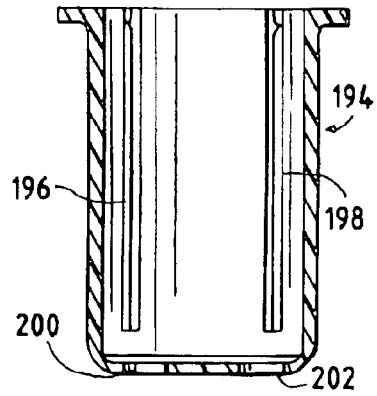
FIG. 13B is a cross-sectional view of the enclosure shown in FIG. 13 taken through line 13B—13B of FIG. 13A.

Extending radially through the axis 174 of the lower third of the float 154 is a transverse slot 176 which divides the radially flange 166 in half, leaving each of the two poles 168, 170 approximately centered on each of the two halves of the divided flange 166. As best shown in FIGS. 8C and 8D, at the very center of the flange 166, the slot 176 has an enlargement 178. As best shown in FIGS. 4, 5, 8B, 8C, and 12, passing through the enlargement 178 is an upwardly extending protrusion 180 from the piston 144. The protrusion 180 has a radial flange 182 at the upper end thereof such that when the two halves of the radial flange 166 will snap around the protrusion 180. The flange 182 on the piston 144 will thereby lock the float 154 to the piston 144 for axial movement therewith, while allowing the float 154 to rotate around the protrusion 180 with a minimal resistance from the piston 144.

The length of the float 154 is such that when the piston 144 is at its lowest position within the cavity 145, the upper end 156 of the float 154 will fit within the lower tubular portion 128 of the stem 102. The ribs 162, 164 on the float 154 will slideably fit within the longitudinal slots 130, 132 of the stem 102 such that the float 154 is locked for rotation with the stem 102 but is axially moveable within the cavity 145 independent of the movement of the stem 102.

Referring to FIGS. 3, 4, 5, 7, and 13, the actuator cap 53 is generally cylindrical in shape with a tubular dispensing nozzle 54 extending radially outward from the upper end thereof. The actuator cap 53 has a bore 184 extending into the lower end thereof, the cross-section of which is complementary to the cross-section of the upper end of the stem having the flat 106 thereon, such that the nozzle 54 can be positioned in only one orientation with respect to the upper end of the stem 102. The actuator cap 53 has a passage 186 extending from the upper end of the bore 184, through the body of the cap 53 and through the center of the discharge nozzle 54 for discharging pressurized liquid from within the cavity to the ambient.

As previously described, the invaginations 100(1) to 100(8) in the surface of the housing 69 are arranged in pairs where the members of each of the pairs are not diametrically apart from one another, but at an angle with respect thereto of 157.50 degrees in one direction and 202.50 degrees in the opposite direction, which corresponds to the angular orientations of the poles 168, 170 of the float 154.

As shown in FIGS. 2, 6, 6A, 6B, 6C and 6F, printed on the upper portion 55 of the housing 69 adjacent each of the notches 57 are markings 58 indicating the dosage to be discharged when the actuator cap 53 is positioned with the nozzle 54 to be received in the associated notch 57. The flat 106 positions the actuator cap 53 with respect to the stem 102 and the longitudinal slots 130, 132 through the tubular portion 128 of the stem 102 retain the ribs 162, 164 of the float 154 such that the poles 168, 170 will engage one of the pairs of invaginations 100(1)–100(8) that correspond to the markings 58 numbered from 1 to 8 on the outer surface of the upper portion 55 of the housing 69. For example, when the cap 53 is rotated until the nozzle 54 will be received in the notch 57 bearing the marking 58 of number "1", the poles 168, 170 of the float 154 will be aligned to engage the pair of invaginations 100(1). Rotating the cap 53 until the nozzle 54 be received in the notch 57 bearing the marking 58 of number "2" will cause the float 154 to be rotated within the housing 69 until poles 168, 170 are aligned to engage the invaginations 100(2). In similar fashion rotation of the cap 53 until the nozzle 54 will be received by any other numbered notch 57 will cause the poles 168, 170 to engage the corresponding invagination 100(1)–100(8).

The float 154 is longitudinally moveable upward in the housing 69 until the poles 168, 170 engage the ends of the invaginations 100(1)–100(8) with which they are aligned. Referring more specifically to FIGS. 6B and 6C, each of the pairs of vaginations 100(1)–100(8) has a unique overall length, and accordingly the float 154 has a different length of travel when engaged with each of the pairs of invaginations 100(1) through 100(8). The pair of invaginations numbered 100(8) allow the longest length of travel and the invaginations numbered 100(1) allow the shortest length of travel of the float 154 and the piston 144 attached thereto. A longer stroke of the float 154 and the piston 144 expels a greater amount of liquid through the valve 56 than does a shorter stroke of the float 154 and the piston 144.

Referring to FIGS. 4, 5, 13, 13A, and 13B, an upper coil spring 190 has a lower end that rests against the radial flange 98 retaining the inner retainer 88 and the upper end that rests against the actuator cap 53 for urging the actuator cap 53 and the stem 102 attached thereto in a upward direction. A second lower coil spring 192 extends around the outer circumference of the float 154 with the upper end thereof against a portion of the housing 66 and the lower end thereof resting upon the upper surface of the piston 144 for urging the piston 144 and the float 154 in a downward direction. Extending around the outer periphery of the housing 69 is a tubular plastic shell 194 having a plurality of openings 196, 198, 200, 202 in the walls thereof for allowing liquid 64 inside the bag 63 to pass therethrough and into the refill ports 80, 82 of the valve 56.

Referring to FIG. 3, the propellant 65 within the container 52 compresses the bag 63 containing the liquid 64 around the valve 56. To actuate the dispenser 50, the actuator cap 53 is rotated until the nozzle 54 points to the notch 57 for the dosage of liquid that is desired to be dispensed. Thereafter, the actuator cap 53 is pressed downwardly compressing the upper spring 190. As the stem 102 moves downwardly, the cylindrical outer wall 120 of the stem moves across the refill ports 80, 82 thereby sealing the cavity 145 from the liquid 64 in the bag 63. As the stem 102 is further depressed the opening 114 in the wall of the stem 102 moves below the annular seal 90 allowing the passage 112 to communicate with the cavity 145 such that pressurized liquid 64 in the cavity 145 can escape through the passage 112 to the ambient. Pressure within the container 52 will force the piston 144 to move upward through the cylindrical inner wall 92 and compress the lower spring 192 until the poles 168, 170 engage the invaginations 100(1)–100(8) corresponding to the notch 57 into which the nozzle 54 of the actuator cap 53 is received. The movement of the piston 144 expels liquid in the cavity 145 through the passage 112 in the stem 102. The actuator cap 53 is held in the depressed condition until the poles 168, 170 of the float 154 engage the associated invaginations 100(1)–100(8) after which the actuator cap 53 is released. When the actuator cap 53 is released, the upper spring 190 urges the cap 53 and the stem 102 upwardly the refill ports are again opened. Further upward movement of the stem 102 causes the discharge ports 114 to again be sealed by the tubular seal 90 preventing further discharge of liquid. The second coil spring 192 urges the piston 144 downward causing liquid 64 from the bag 63 to pass through the ports 80, 82 along the longitudinal indentations 122 and into the cavity 145 allowing the cavity 145 to be refilled.

Referring to FIGS. 2 and 3, a desirable feature of the present invention is that upper portions 55 of the valve 56 extend outward of the ferrule 66, which is crimped around the radial flange 67 of the housing 69. An O-ring 68 positioned at the opening of the container 52 and a bead surrounding the opening of the bag 63 after which the ferrule 66 is crimped, sealing the container 52 and the bag 63 around the circumference of the valve assembly 54.

Another advantage of the valve assembly of the present invention is that by virtue of positioning the poles 168, 170 so as not to be at 180 degrees from one another, the actuator 53 can be rotated to notches 57 that are angular spaced by 180 degrees from one another and discharge different volumes of liquid. The dispenser 50 is depicted as having eight different notches 57, with each notch dispensing a different dosage of liquid 64. The dispenser 50 could easily be made with ten notches 57 so if the volume of liquid being dispensed could be divided into increments of tenths or in such other fractions as may be desirable.

While the present invention has been described with respect to a single embodiment, it will be appreciated that many modifications and variations may be made without departing from the true spirit and scope of the invention. It is therefore the intent of the dependent claims to cover all such variations and modifications, which fall within the true spirit and scope of the invention.

What is claimed:

1. A dispensing valve for dispensing a quantity of pressurized liquid where said quantity of liquid being dispensed can be adjustably selected, said valve comprising, a generally tubular valve housing having an inner wall and an annular upper surface within said inner wall, an axially moveable piston within said inner wall wherein said inner wall, said annular upper surface, and said piston define a cavity, a stem having a longitudinal axis and an axial discharge passage leading to a discharge port, said stem axially moveable between an extended position wherein said discharge passage is sealed and a depressed position wherein said discharge passage is in communication with said cavity.

means for urging said stem toward said extended position, said stem rotatable about said longitudinal axis, a float within said cavity, means for locking said float for rotation with said stem, said float axially moveable within said cavity independent of said stem, means on said valve housing and on said float for selectively adjusting the travel of said piston to thereby selectively adjust the volume of said cavity wherein said travel is adjusted by changing said angular orientation of said stem and said float about said axis.

2. The dispensing valve of claim 1 wherein said valve housing has a refill port extending through said inner wall.

3. The dispensing valve of claim 1 wherein said float is locked for axial movement with said piston and said float is rotatable independent of said piston.

4. The dispensing valve of claim 1 and further comprising means for urging said piston in a direction which increases the volume of said cavity.

5. The dispensing device of claim 4 where said means for urging comprises a coil spring wrapping around an outer circumference of said float and applies pressure to said housing and said piston.

6. The dispensing valve of claim 1 further comprising a diaphragm across an open end of said housing and across a surface of said piston for providing a seal to prevent liquid from leaking around said piston and into said cavity.

7. The dispensing valve of claim 1 wherein said valve housing has a refill port extending through said wall and said stem further comprises means to sealing said refill port where said stem is in said depressed position.

8. A dispensing device comprising a container and a valve in accordance with claim 1.

9. The dispensing valve of claim 1 wherein said means for selectively adjusting the travel of said piston comprises a plurality of vaginations in one of the said housing and said float and a plurality of spaced poles in the other of said housing and said float.

10. The dispensing valve of claim 9 wherein there are two poles nearly diametrically spaced from each other and said vaginations are in pairs of equal depth spaced to be engaged by the two poles.

11. A dispensing valve for dispensing a quantity of pressurized liquid where said quantity of liquid being dispensed can be adjustably selected, said valve comprising, a generally tubular valve housing having a wall, an axially moveable piston within said wall wherein said wall and said piston define a cavity, a stem having a longitudinal axis and an axial discharge passage leading to a discharge port, said stem axially moveable between an extended position wherein said discharge passage is sealed and a depressed position wherein said discharge passage is in communication with said cavity, means for urging said stem toward said extended position, said stem rotatable about said longitudinal axis, a float within said cavity, means for locking said float for rotation with said stem, said float axially moveable within said cavity independent of said stem, a coil spring wrapped around said float, said coil spring applying pressure to said housing and said piston.

12. A dispensing valve for dispensing a quantity of pressurized liquid where said quantity of liquid being dispensed can be adjustably selected, said valve comprising, a generally tubular valve housing having a wall, an axially moveable piston within said wall wherein said wall and said piston define a cavity, a stem having a longitudinal axis and an axial discharge passage leading to a discharge port, said stem axially moveable between an extended position wherein said discharge passage is sealed and a depressed position wherein said discharge passage is in communication with said cavity, means for urging said stem toward said extended position, said valve housing having a refill port extending through said wall for admitting liquid to enter said cavity and said stem further comprises means for sealing said refill port when said stem is in said depressed position.

13. The dispensing valve of claim 1 and further comprising a diaphragm across an open end of said housing and across a surface of said piston for providing a seal to prevent liquid from leaking around said piston and into said cavity.

* * * * *

UNITED STATES PATENT AND TRADEMARK OFFICE

CERTIFICATE OF CORRECTION

PATENT NO. : 6,910,606 B2
DATED : June 28, 2005
INVENTOR(S) : James H. Martin et al.

It is certified that error appears in the above-identified patent and that said Letters Patent is hereby corrected as shown below:

Column 1,
Line 52, after "device" delete "of U".
Line 67, beginning of the line, delete "should provide".

Column 2,
Line 33, after "the" delete "direction of the".

Column 11,
Line 4, beginning of the line, delete "surrounding" and substitute -- surrounds --.

Column 12,
Line 7, after "means" delete "to" and substitute -- for --.

Signed and Sealed this

Twenty-seventh Day of September, 2005

JON W. DUDAS
*Director of the United States Patent and Trademark Office*